US009823051B2

(12) United States Patent
Meyer et al.

(10) Patent No.: US 9,823,051 B2
(45) Date of Patent: Nov. 21, 2017

(54) MEASURING FRAME FOR CONTACTLESS OPTICAL DETERMINATION OF A GUNSHOT POSITION AND ASSOCIATED MEASUREMENT PROCESS

(71) Applicant: MEYTON ELEKTRONIK GMBH, Melle (DE)

(72) Inventors: Paul Meyer, Mettingen (DE); Stefan Tegelhütter, Melle (DE); Udo Witte, Spenge (DE)

(73) Assignee: MEYTON ELEKTRONIK GMBH (DE)

( * ) Notice: Subject to any disclaimer, the term of this patent is extended or adjusted under 35 U.S.C. 154(b) by 69 days.

(21) Appl. No.: 14/895,647

(22) PCT Filed: Jun. 3, 2014

(86) PCT No.: PCT/EP2014/061476

§ 371 (c)(1),
(2) Date: Apr. 11, 2016

(87) PCT Pub. No.: WO2014/195310

PCT Pub. Date: Dec. 11, 2014

(65) Prior Publication Data

US 2016/0223299 A1 Aug. 4, 2016

(30) Foreign Application Priority Data

Jun. 3, 2013 (DE) ..... 10 2013 009 248

(51) Int. Cl.
*G01B 11/14* (2006.01)
*F41J 5/02* (2006.01)

(52) U.S. Cl.
CPC ..... *F41J 5/02* (2013.01)

(58) Field of Classification Search
CPC ..... F41J 5/02; F41J 1/10; G01V 8/20; G02B 5/124; G06F 3/0421; A63F 3/00643
(Continued)

(56) References Cited

U.S. PATENT DOCUMENTS 3,727,069 A 4/1973 Crittenden, Jr. et al.
3,807,858 A * 4/1974 Finch ..... F41J 5/02 250/222.2

(Continued)

FOREIGN PATENT DOCUMENTS

CN 201149467 11/2008
DE 4115995 A1 11/1992

(Continued)

OTHER PUBLICATIONS

PCT/EP2014/061476 International Seach Report dated Jul. 29, 2014 (6 pages).

(Continued)

*Primary Examiner* — Tarifur Chowdhury
*Assistant Examiner* — Isiaka Akanbi
(74) *Attorney, Agent, or Firm* — Michael Best & Friedrich LLP

(57) ABSTRACT

The invention relates to a measuring frame (106) for optically ascertaining a perforation position of a projectile (134) through a target surface (102) in a contactless manner. In addition, the invention relates to a corresponding measurement and analysis method. The invention further relates to a display system which uses at least one such measuring frame (106). The measuring frame comprises at least one first (120) radiation source for emitting a first diverging radiation field, at least one second radiation source for emitting a second diverging radiation field, said first and second radiation fields intersecting at an angle on a plane transverse to a perforation direction, and at least one first (126) and at least (Continued)

one second (126') optical receiving device, which are paired with the at least one first and second radiation source, respectively. Each of the optical receiving devices has an array of optical receiving elements which can be analyzed such that a spatially extended shading position resulting from the projectile to be detected is determined.

15 Claims, 21 Drawing Sheets

(58) Field of Classification Search
USPC ..... 356/600–624
See application file for complete search history.

(56) References Cited

U.S. PATENT DOCUMENTS

| | | | | |
|---|---|---|---|---|
| 4,313,109 | A | 1/1982 | Funk et al. | |
| 4,949,972 | A | 8/1990 | Goodwin et al. | |
| 5,637,866 | A * | 6/1997 | Riener | F41J 5/02 250/206.1 |
| 5,988,645 | A | 11/1999 | Downing | |
| 6,717,684 | B1 * | 4/2004 | Fikes | F41J 5/02 250/221 |
| 2009/0273794 | A1 * | 11/2009 | Ostergaard | G02B 6/0016 356/614 |
| 2010/0066016 | A1 * | 3/2010 | Van De Wijdeven | G06F 3/0421 273/237 |
| 2012/0147386 | A1 * | 6/2012 | Liao | G06F 3/0428 356/623 |
| 2012/0194802 | A1 | 8/2012 | Walti-Herter | |

FOREIGN PATENT DOCUMENTS

| | | |
|---|---|---|
| DE | 102007020604 A1 | 11/2008 |
| JP | 2001187269 | 7/2001 |

OTHER PUBLICATIONS

DE102013009248.5 Office Action dated Jan. 28, 2014 (6 pages).

MEYTON Elektronik, Measuring Frame MF4R1, MF4R3 Cleaning Instruction, "Cleaning the Measuring Frame" Reinigungsanleitung 2009 (14 pages).

MEYTON Elektronik, "Our biggest advantages for the shooting sport" 2010 (40 pages).

Japanese Patent Office Action for Application No. 2016-517270 dated Jan. 31, 2017 (11 pages including translation).

Russian Patent Office Action for Application No. 2015149696/28(076448) dated Apr. 19, 2017 (19 pages—Including translation).

* cited by examiner

MEASURING FRAME FOR CONTACTLESS OPTICAL DETERMINATION OF A GUNSHOT POSITION AND ASSOCIATED MEASUREMENT PROCESS

BACKGROUND OF THE INVENTION

The present invention relates to a measuring frame for contactless optical determination of a gunshot position of a bullet through a target surface. Furthermore, the present invention also relates to a pertaining measurement and evaluation process. In addition, the present invention relates to a display system that uses at least one such measuring frame.

Measuring frames that determine a gunshot position by means of contactless light barrier technology have been used among sports shooters and for the training of shooters for quite some time. In such optical measurement processes, a bullet that flies through the measuring frame is measured in a contactless way by means of infrared barriers. An individual infrared barrier is thereby composed of an infrared sender that sends infrared light in a focused light beam, and an infrared receiver that is situated opposite to the infrared sender and that measures the brightness of the incoming infrared light beam. Depending on the size of the measuring frames, up to 500 independent light barriers are installed and arranged in a solid grid screen on the internal sides of the frame.

The infrared senders of the individual light barriers create a continuous light curtain within the frame. If a bullet flies through this light curtain, several light barriers are interrupted partially or completely both on the horizontal X-axis as well as on the vertical Y-axis of the measuring frame.

The advantage of the solution consists on one hand of the absence of wear as no consumables such as paper or rubber bands are involved. On the other hand, the use of optical measuring frames has the advantage of high measurement accuracy and a low susceptibility with regard to contamination and temperature variations.

Such linear measuring frames are known for example from the DE 4115995 A1 or the EP 034284 A1. From the U.S. 2012 0194802 A1, also a combined measurement device is known that uses two crossing optical light barriers to cover the innermost target area, and an acoustic process to determine a gunshot position in an outside area. Thereby, a series of light receivers that are arranged on a circular arc segment are used to determine the intensity of the radiation, which is emitted from a light sender that is located opposite to them, on the diverse points of the circular arc. The gunshot position is determined based on the different brightness values.

However, there is still the need to indicate measurement frames with increased levels of accuracy and robustness that can be produced in a cost-efficient way and that are not made of any wear materials such as acoustic membranes while being still compliant with the maximum permitted dimensions for measuring frames of this type.

SUMMARY OF THE INVENTION

In this context, the invention is based on the idea that a measuring frame for contactless optical determination of a gunshot position of a bullet through a target surface has at least one first radiation source to send out a divergent radiation field, as well as a second radiation source to send out a second divergent radiation field. The first and the second radiation field intersect in one plane transversally to a gunshot direction at an angle. At least a first and at least a second optical receiver unit are associated respectively to the first and the second radiation source, receive the emitted radiation and analyze it.

In particular, each of the optical receiver units has an array of optical receiver elements that are analyzed in a way that a spatially extended shading system is determined following the bullet to be detected. In particular, the optical receiver elements are arranged in at least two rows and the receiver elements of one row are shifted in relation to the receiver elements of an adjacent row.

An evaluation process can be performed in an advantageous way by means of the arrangement according to the invention, which calculates, using the delimitation of the determined shading units and the position of the respective sender radiation source, tangents to the detected bullet. By means of such a calculation method, a much higher accuracy can be achieved and also the size of the bullet, i.e. the respective caliber, can be determined besides the gunshot position, i.e. the position of a center of the bullet.

Therefore, for example light-emitting diodes, LEDs that send out infrared radiation, or laser diodes such as VCSEL (vertical cavity surface emitting laser), in which laser beams are emitted perpendicularly to the plane of the semiconductor chip, are suitable radiation sources. Photo diodes, for example, are used as detector elements. Of course, any other suitable sensor technologies such as phototransistors can also be used.

To maintain a comparatively short light path and consequently small overall dimensions of the measuring frame, the resolution of the shading system on the receiver side has to be particularly short and it must be ensured for an arrangement with a plurality of radiation fields that no optical crosstalk from an unrelated radiation source will occur. To implement such a high-resolution arrangement, an orifice system can be installed according to an advantageous further development of the present invention. Thereby, one or several orifices can be arranged in close vicinity to the radiation source on one hand in order to form the diverging beam accordingly before it reaches the measuring field.

On the other hand, orifices can be installed in close proximity to the receiver elements in order to delimit the radiation that falls onto the receiver elements after having passed through the measurement area. A particularly high level of accuracy can be achieved by combining this orifice technology in a way that an appropriate orifice arrangement is installed both ahead of the radiation source as well as ahead of the receiver elements.

The measuring frame according to the invention can be implemented in a particularly simple and efficient way if the first and the second radiation source and the associated first and second receiver unit are arranged in a way that the central axes of the emitted radiation fields intersect in a substantially right-angled manner. Besides a simplified mechanical design of this arrangement, also the geometrical calculation of the tangents is particularly easy with this arrangement as the measuring frame can be interpreted as the first quadrant of a Cartesian coordinate system. To extend the measurement precision and the recordable measurement range, a plurality of radiation sources and associated receiver systems can be provided for.

Thereby, it is particularly advantageous if the measuring frame that delimits the target area in a substantially right-angled way is formed by essentially equal measuring blocks that are installed alongside the edges of the rectangular delimitation. This means that each of the edges of the measuring frame carries radiation sources and receiver units so that the entire target surface is covered by a plurality of intersecting diverging radiation fields.

In the evaluation process according to the invention, four tangents can in principle be calculated on the bullet having flown through. However, the calculation of only three tangents is required for an unambiguous determination of the gunshot position. Hence, there is redundancy in case of calculating four tangents, which can be used for a plausibility check of the measurement result.

The arrangement according to the invention also offers the possibility to include a calibration step. Thereby, at least one of the radiation sources is switched off for a short time and a difference value of the radiation intensity between the illuminated and the non-illuminated state of the associated receiver unit is determined and used to calculate a calibration factor. These calibration values can, for example, be determined anew after each measurement process.

This way, lighting changes, for example due to contamination during operation, can be determined by means of comparing the measured difference value with a threshold value. A warning message can be generated if this threshold value is undercut, i.e. if the intensity of the emitted radiation is no longer in line with the requirements. A user can be informed about a critical state of the measuring frame in due time, for example before measurement errors occur due to contamination.

By means of the process according to the invention, the caliber of a bullet that flies through the measuring frame can also be calculated besides the gunshot position without extra work. This can equally be used for a plausibility check.

BRIEF DESCRIPTION OF THE DRAWINGS

For a better understanding of the present invention, the latter shall be explained in greater detail by means of the embodiment examples shown in the following Figures. Identical parts are thereby marked with identical reference signs and identical component designations. Furthermore, some characteristics or combinations of characteristics from the different shown and described embodiments can also constitute independent, inventive or invention-based solutions.

The Figures show:

FIG. 28 a top view of the array of receiver elements while a bullet is flying through;

DETAILED DESCRIPTION

Figure 1:
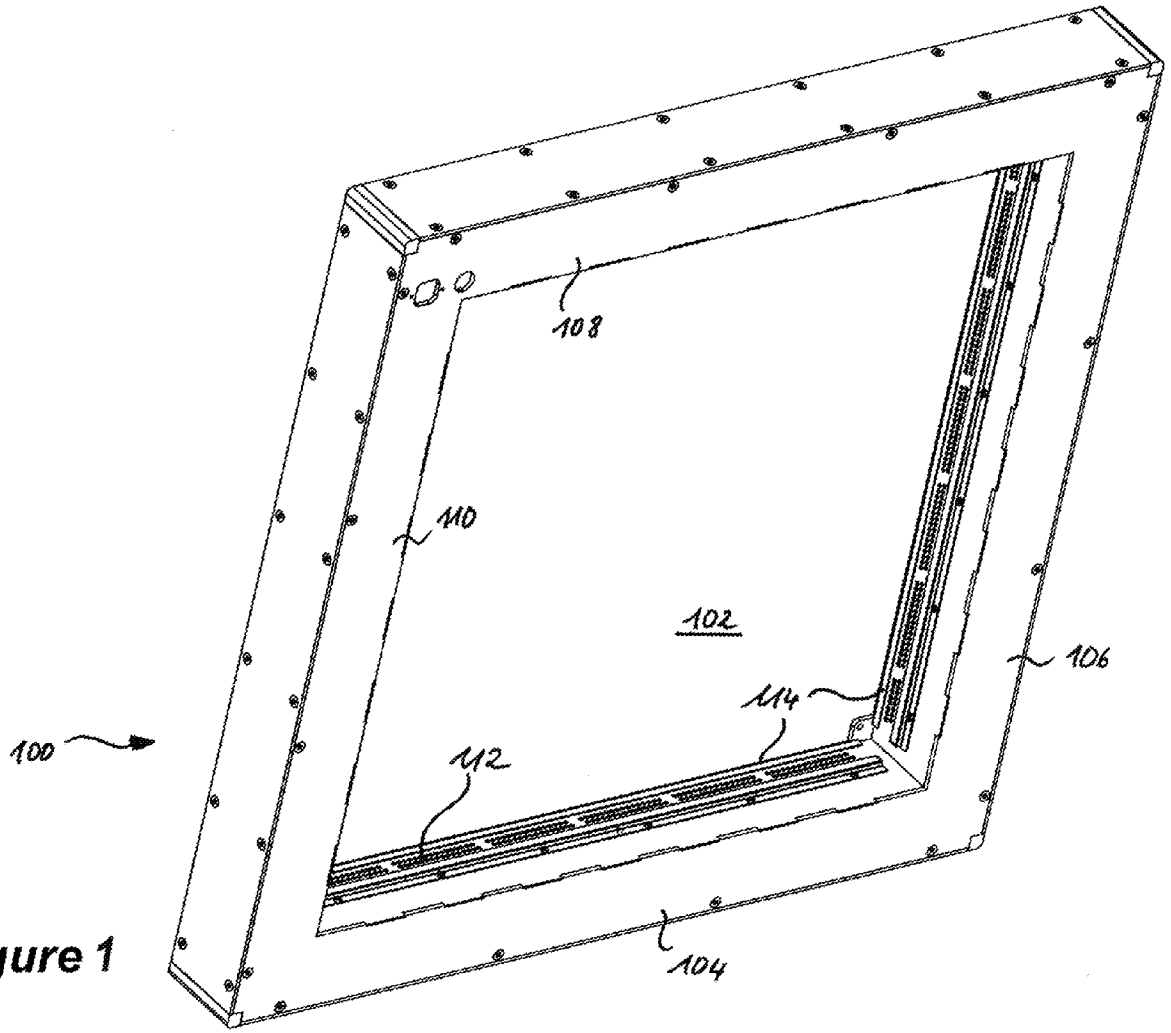
FIG. 1 a perspective display of a measuring frame according to the present invention.

FIG. 1 shows a perspective display of a measuring frame 100 according to an advantageous embodiment of the present invention.

In the shown embodiment, the measuring frame is substantially square-shaped and surrounds a target plane 102, which is also essentially square-shaped and which the bullets to be detected are flying through.

As will be illustrated by the following Figures, each of the measuring frame rails 104, 106, 108 and 110 emits diverging radiation fields that respectively fall onto the measuring frame rail opposite to them. Thereby, the radiation fields of the respective measuring frame rails that are perpendicular to each other intersect in a right-angled way.

Each of the measuring frames 104 to 110 has both radiation sources as well as optical receiver units. In FIG. 1, only the outermost orifice apertures for the receiver units arranged below them can be seen.

As they delimit the gunshot area 102, these orifice arrays 112 are also covered by a transparent cover, for example an acrylic glass panel. FIG. 1 shows the pertaining brackets 114.

Figure 2:
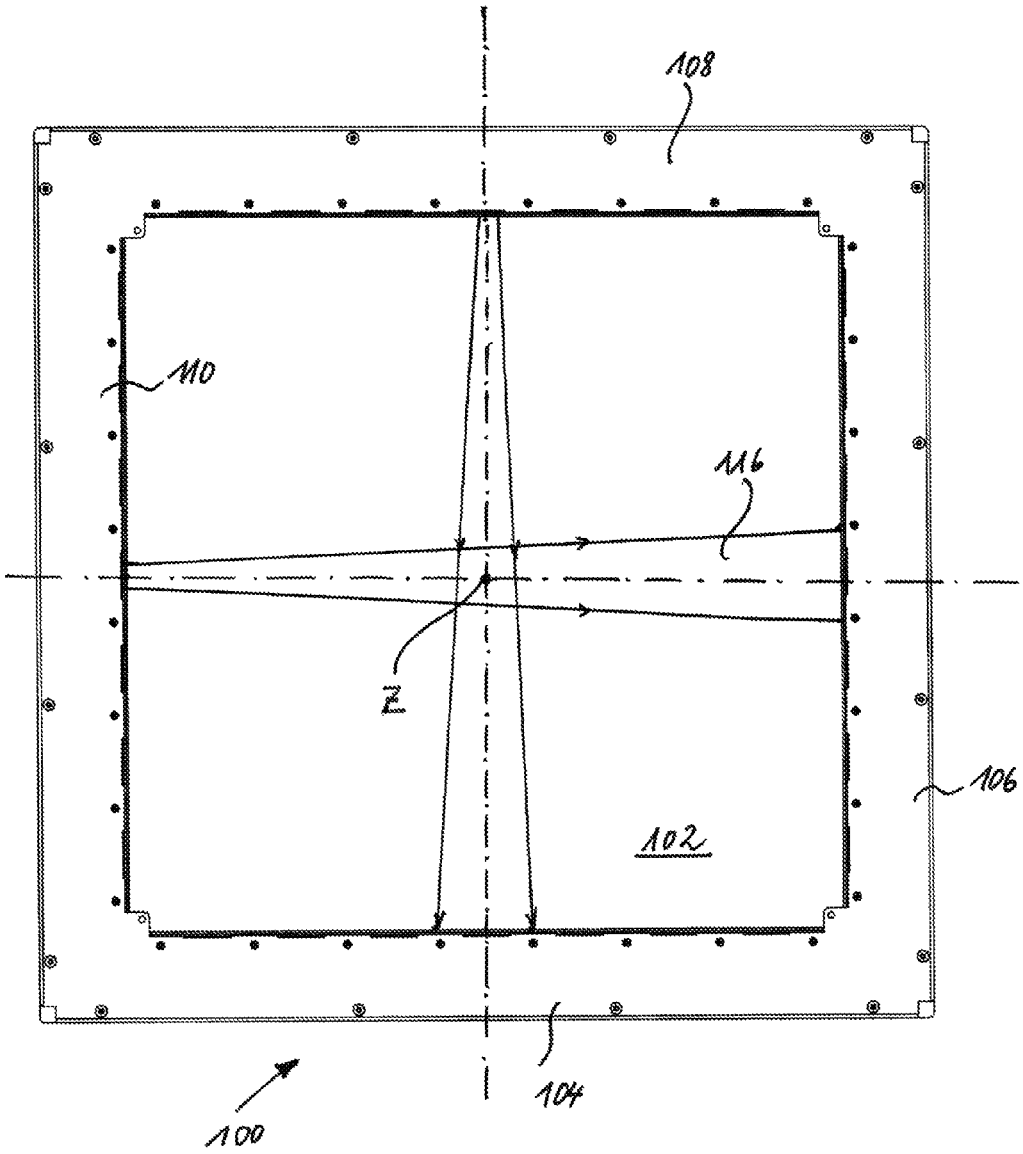
FIG. 2 a top view of the measuring frame from FIG. 1.

FIG. 2 shows a top view of the measuring frame 100 from FIG. 1. FIG. 2 schematically illustrates the course of two diverging radiation fields 116 that intersect in the target plane 102. As each of the measuring frame rails is now equipped accordingly with radiation sources and receiver units, the overall target plane can be covered with these diverging radiation fields 116. The center Z of the target plane is clearly defined by the mechanical conditions in the solution according to the invention.

Suitable radiation sources are for example light-emitting diodes (LED) that emit in the infrared range. Of course, other radiation sources such as laser diodes or similar equipment can also be used. The respective receiver unit is chosen in a way as to match the installed radiation source type. This can be for example photo diodes or phototransistors.

Figure 3:
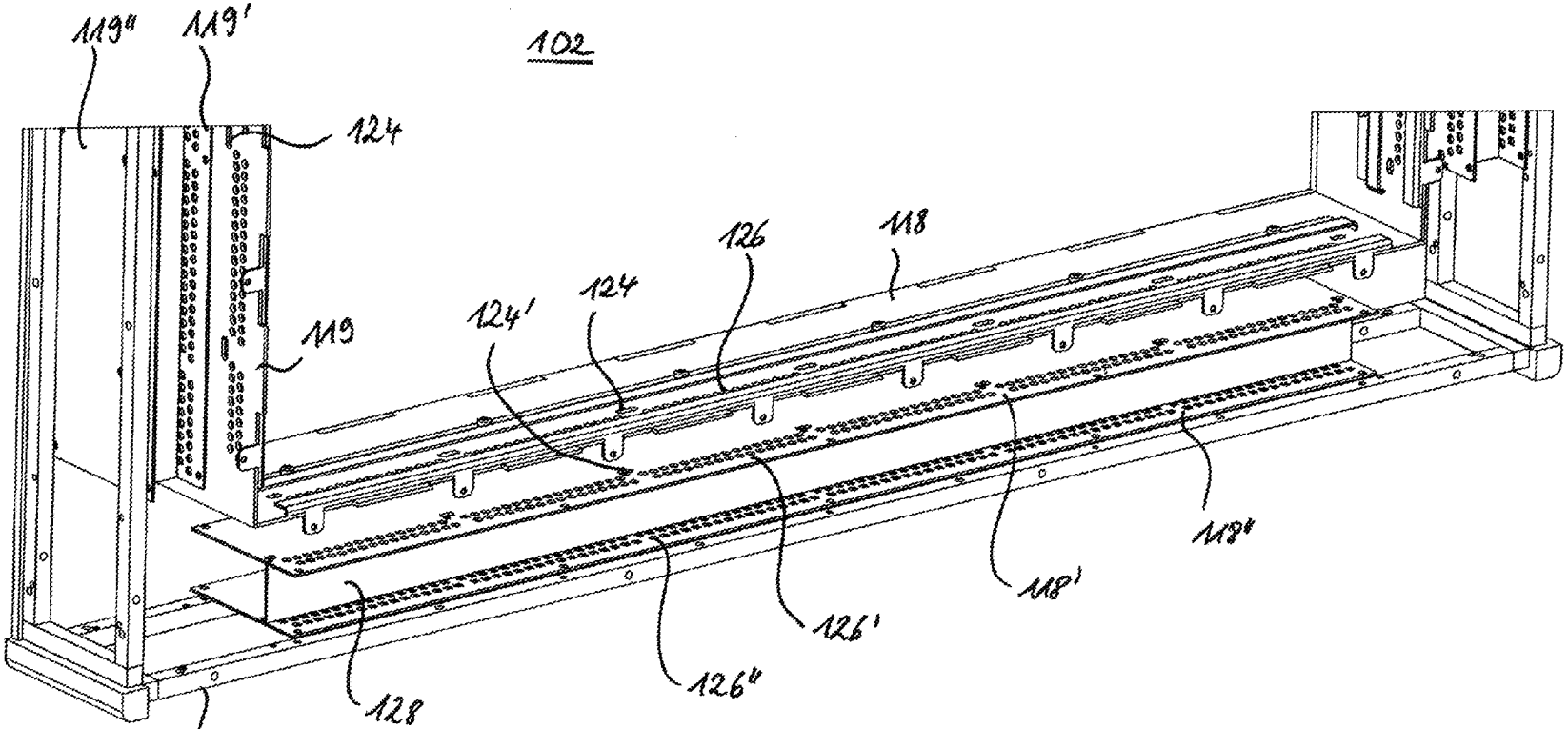
FIG. 3 a partially opened detail view of the measuring frame according to the invention.

According to the present invention, diverse orifice rails are arranged on each of the measuring frame rails 104, 106, 108, 110. Thereby, each of the orifice rails comprises pinhole apertures to form the emitted radiation at a place that is located in direct vicinity to the radiation sources, and pinhole apertures to focus the radiation that falls onto the receiver at a place that is located directly above the receiver elements. FIG. 3 contains a section view to illustrate the arrangement of the orifice rails.

According to the invention, there are two types of orifice rails: on one hand the rails that are arranged for example at the bottom and on the right, and the ones that are installed at the top and on the left on the other hand. This ensures that respectively two different rails are positioned opposite to each other so that the radiation emitted by the radiation source falls onto the pertaining receiver elements on the measuring frame rail on the opposite side.

FIG. 3 shows an embodiment in which three first orifice rails 118, 118' and 118" are provided for. Thereby, each of the orifice rails 118, 118' and 118" has pinhole apertures to form the emitted radiation field and to cover the radiation to be received after passing through the target plane. As illustrated in the following Figures, the orifice rail 118 that is located closest to the target plane 102 has long pinhole apertures 124 to form the radiation field 116 before the latter enters the target plane. Furthermore, the orifice rail 118 has circular pinhole apertures for the radiation field that enters from the measuring frame rail located on the opposite side, which limit the radiation arriving on the receiver elements (reference sign 126). At a certain distance to the first orifice rail 118 there is another orifice rail 118' that has on one hand more narrowly limited pinhole apertures 126' to limit the incident radiation and on the other hand a slightly smaller long pinhole aperture 124' to form the emitted radiation.

The third orifice rail 118" is arranged directly above the circuit carrier, which is not shown here and on which the LEDs and photodiodes are installed. In this context, FIG. 3 only shows the array of receiver pinhole apertures 126" as a partition orifice 128 is to be installed as a shield against undesired scattered radiation from the radiation sources located in this measuring frame rail.

The respective second orifice rails 119, 119' and 119" are different from the first orifice rails 118, 118' and 118" due to the position of the sender orifices and receiver orifices. This position is chosen in a way that a straightforward interaction with the receiver elements that are located directly opposite to them is ensured. The dimensions of the receiver pinhole apertures and the sender pinhole apertures, however, are designed identically for reasons of symmetry.

Figure 4:
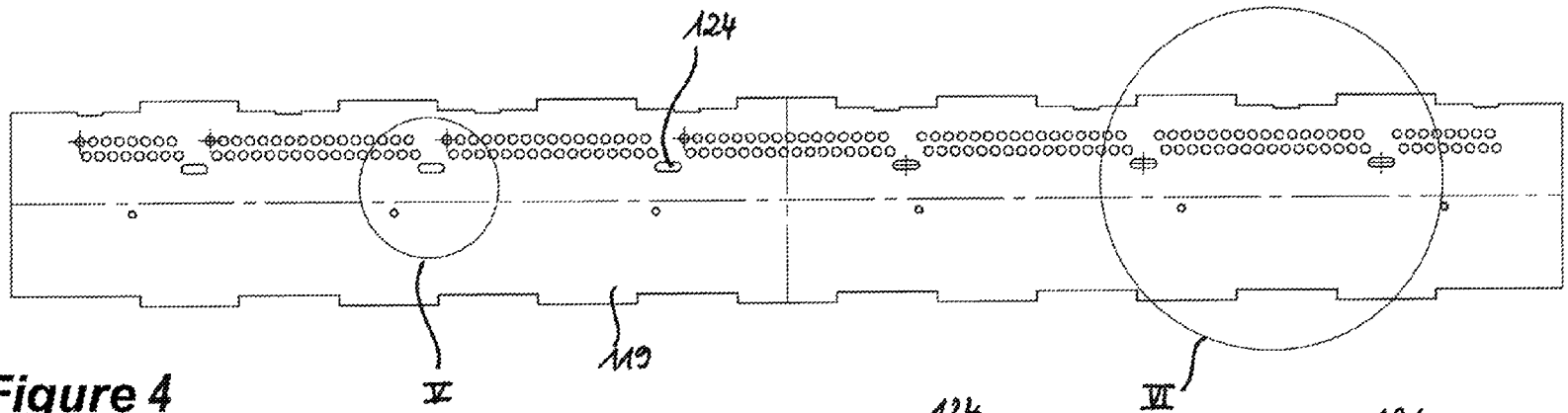
FIG. 4 a top view of a first orifice system.
Figure 5:
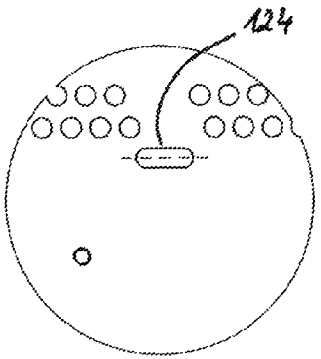
FIG. 5 a detail from FIG. 4.
Figure 6:
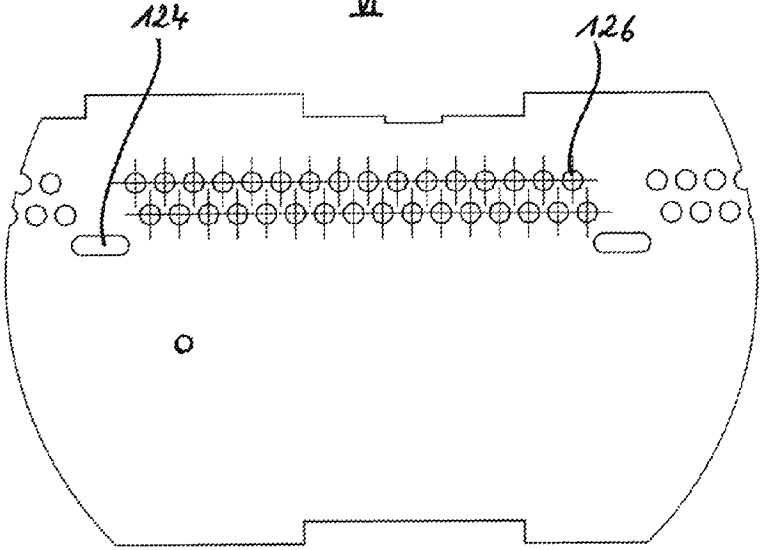
FIG. 6 another detail from FIG. 4.
Figure 7:
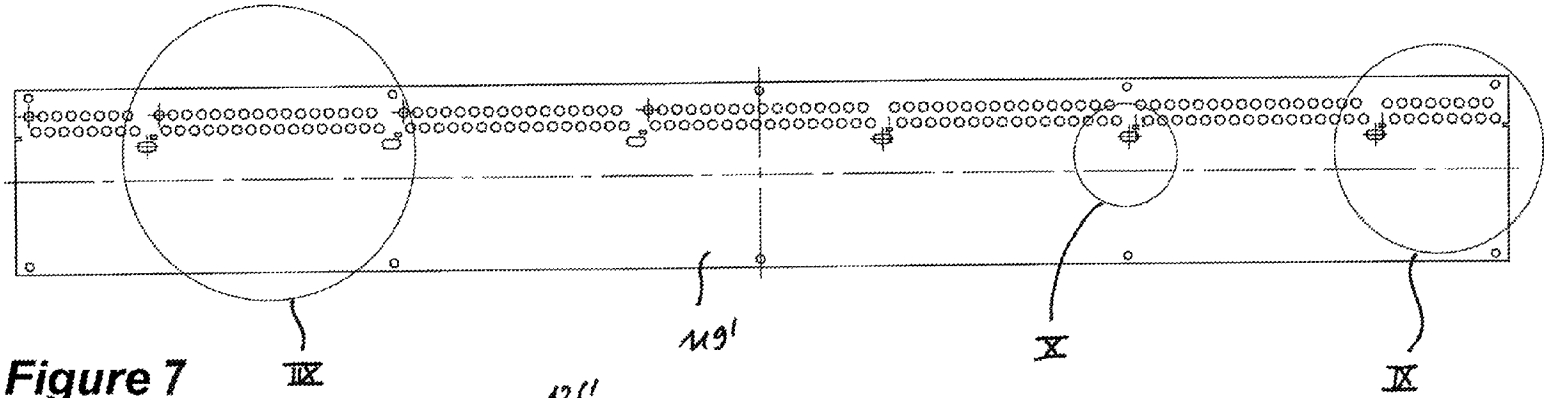
FIG. 7 another orifice system.
Figure 8:
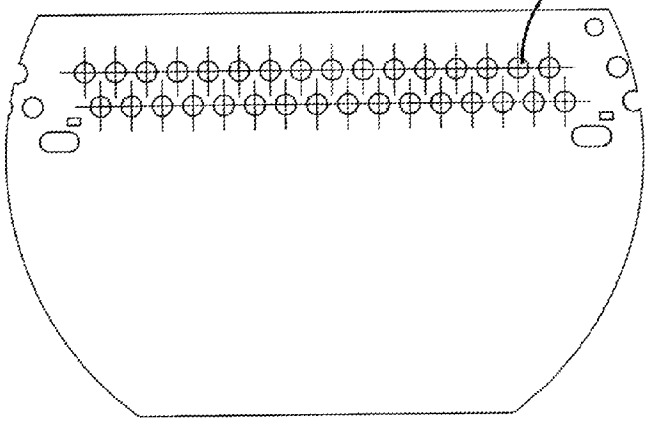
FIG. 8 a detail from FIG. 7.
Figure 9:
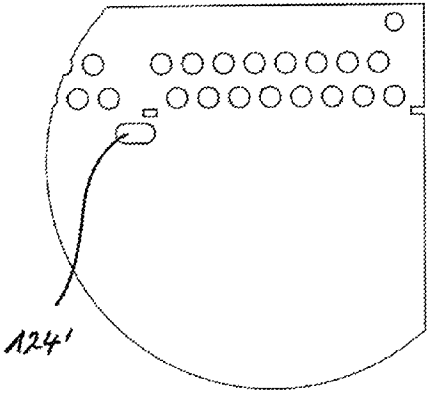
FIG. 9 another detail from FIG. 7.
Figure 10:
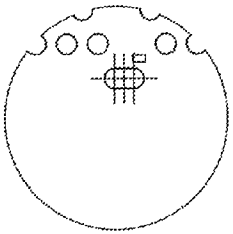
FIG. 10 another detail from FIG. 7.

FIGS. 4 to 6 respectively show the second external orifice 119, which is directly adjacent to the target plane 102. According to the present embodiment, a total of six radiation sources are installed on this measuring frame rail so that the orifice rail 119 is respectively equipped with six long pinhole apertures 124. According to the special embodiment of these Figures, the receiver system has an array of 32 receivers so that there will be one array of 32 receiver pinhole apertures 126 for each receiver element array in optical alignment with these receiver elements in the orifice rail 119.

To improve resolution and accuracy, particularly two rows of receiver elements are arranged in a way that they are shifted in relation to each other as shown in FIG. 6.

The second central orifice rail 119', which is located more closely to the circuit board with the radiation sources and receiver elements, is displayed in FIGS. 7 to 10. The receiver pinhole apertures 126' are thereby chosen to have for example an identical diameter as the receiver pinhole apertures 126. Of course, however, another diameter could also be chosen. The long pinhole apertures for the emitted radiation 124' though has a different shape compared to the long pinhole aperture 124 from FIGS. 4 to 6. This way, the long pinhole aperture 124' can be formed for example with the same radius but a shorter extension than the external pinhole aperture 124. Through the limitation of the emitted radiation to only a very restricted partial area, a clear homogenization of the applied radiation can be achieved according to the invention, which leads to a reduction of measurement errors and a simplified evaluation.

Figure 11:
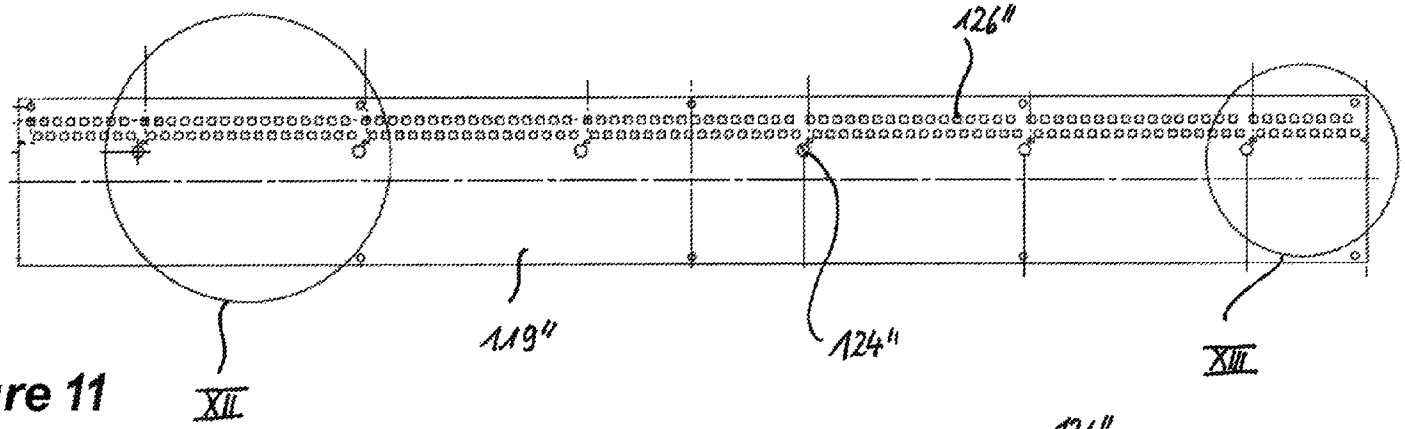
FIG. 11 a top view of a third orifice system.
Figure 13:
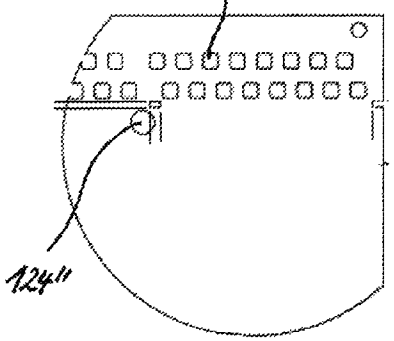
FIG. 13 another detail from FIG. 11.
Figure 12:
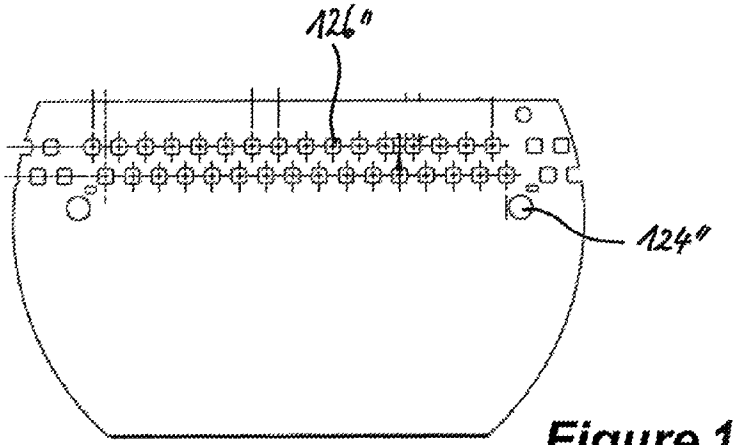
FIG. 12 a detail from FIG. 11.

Finally, FIGS. 11 to 13 show the innermost second orifice rail 119". This orifice rail is located at the shortest distance to the actual components and has a circular sender orifice 124" for a first forming process of the emitted radiation field. Each receiver element is associated with a receiver pinhole aperture 126", which has a substantially rectangular shape with rounded corners. Such a rectangular design enables a particularly efficient use of the incident radiation that arrives at this point as the rectangular receiver pinhole apertures 126" essentially correspond to an outer contour of the underlying receiver elements.

Figure 14:
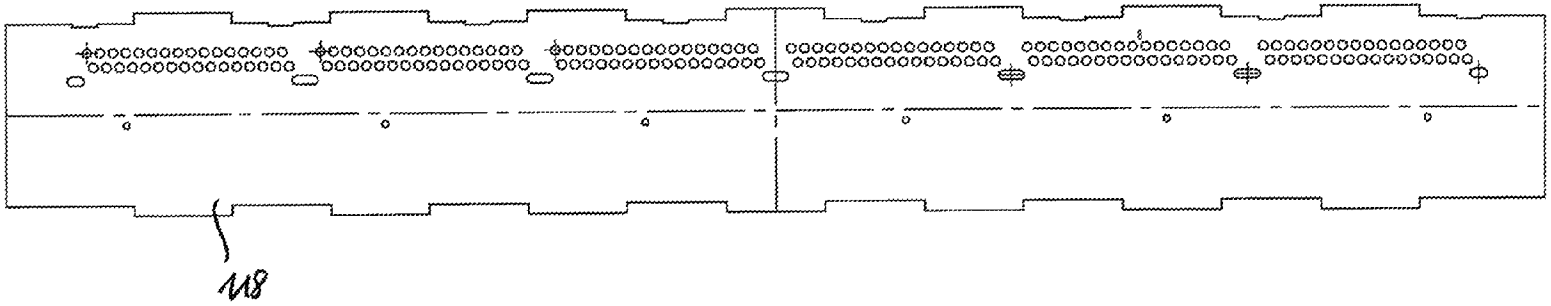
FIG. 14 another orifice system.
Figure 15:
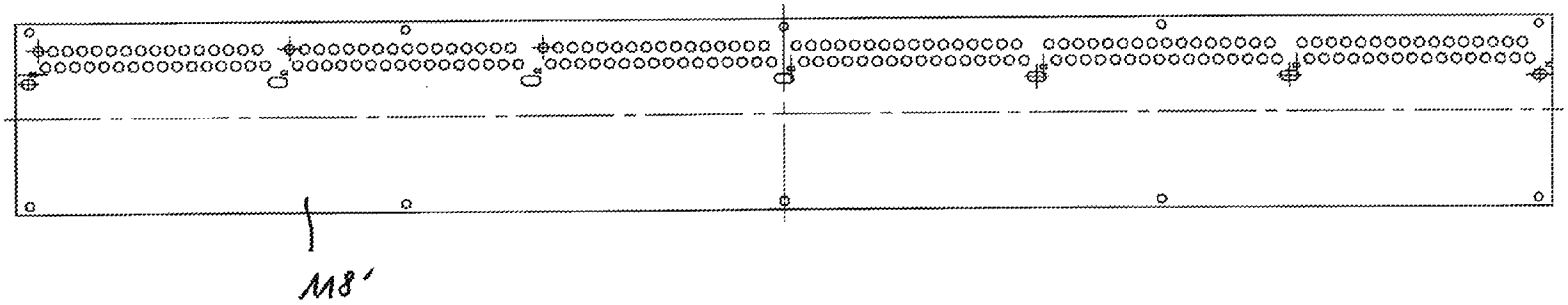
FIG. 15 another orifice system.
Figure 16:
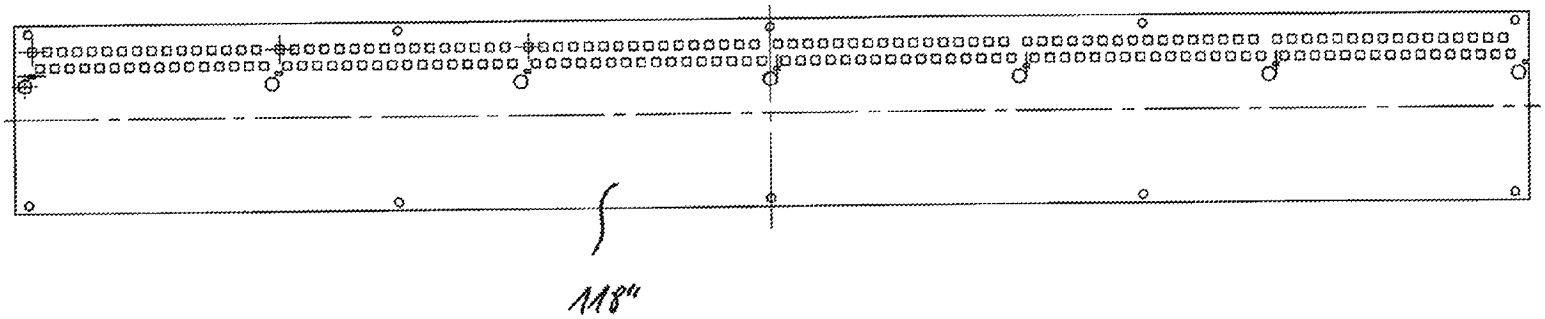
FIG. 16 another orifice system.

FIGS. 14 to 16 illustrate the corresponding first orifice rails 118, 118' and 118" that are installed on the respective measuring frame rails opposite to them so that respectively one array of receiver elements is located opposite to a radiation source. Apart from that, the dimensions and shapes of the sender and receiver pinhole apertures are identical. This comes with the advantage that the punching tools to manufacture the orifice rails can be standardized.

In the following, the radiation path during emission and detection shall be explained in detail with reference to FIGS. 17 to 22.

Figure 17:
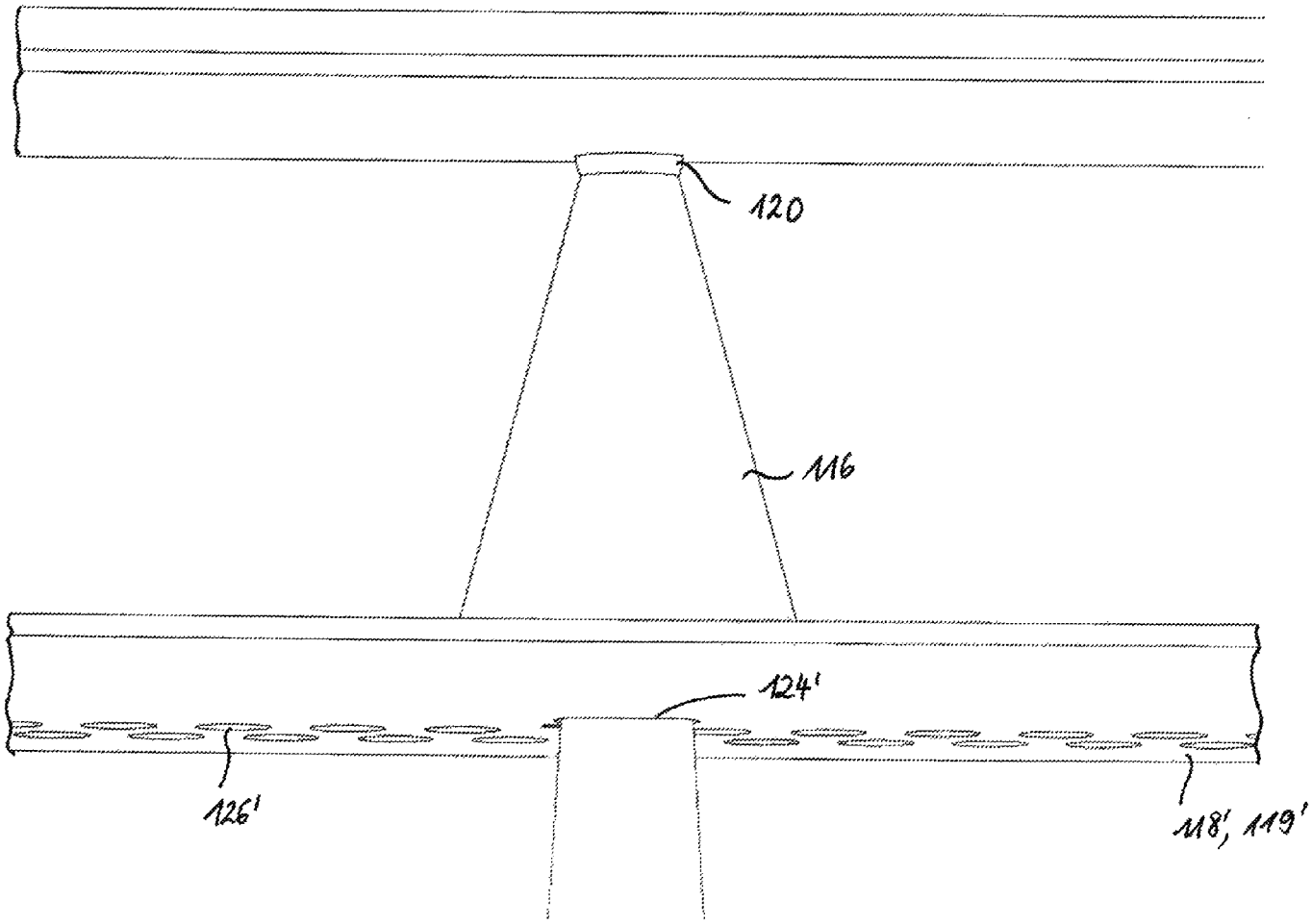
FIG. 17 a schematic diagram of the mode of action of the first beam formers in the orifice systems.

FIG. 17 shows the effect of a long pinhole aperture 124'. In particular, a longish, substantially reduced section is cut out of the cone-shaped radiation field 116 of a radiation source 120, for example a LED, by means of a long pinhole aperture 124'. As already mentioned, homogeneity of the radiation that leaves the long pinhole aperture 124 is increased due to this limitation. It shall be noted that the circular orifice 124" is not displayed in FIG. 17 for the sake of improved clarity. The position of the pinhole aperture in FIG. 17 could also be regarded as equivalent to the position of the radiation source 120.

Figure 18:
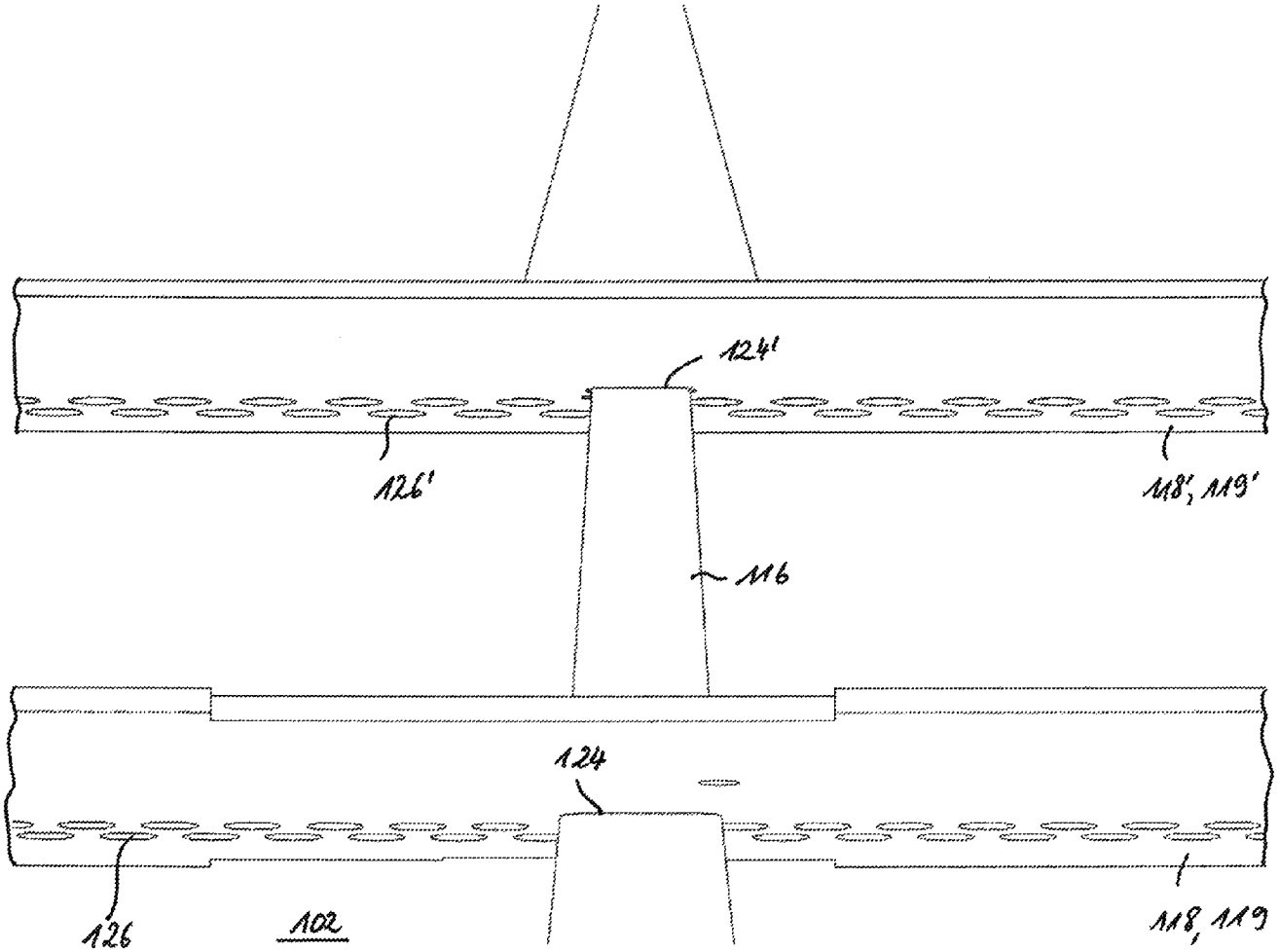
FIG. 18 a schematic display of the mode of action of the second beam formers in the orifice system.

FIG. 18 shows an overview of the mode of action of the two long pinhole apertures 124' and 124 that are situated at such a distance towards each other that the larger long pinhole aperture 124 does not eliminate a significant portion of the radiation anymore but only shapes the marginal areas and reduces the scattered radiation.

Figure 19:
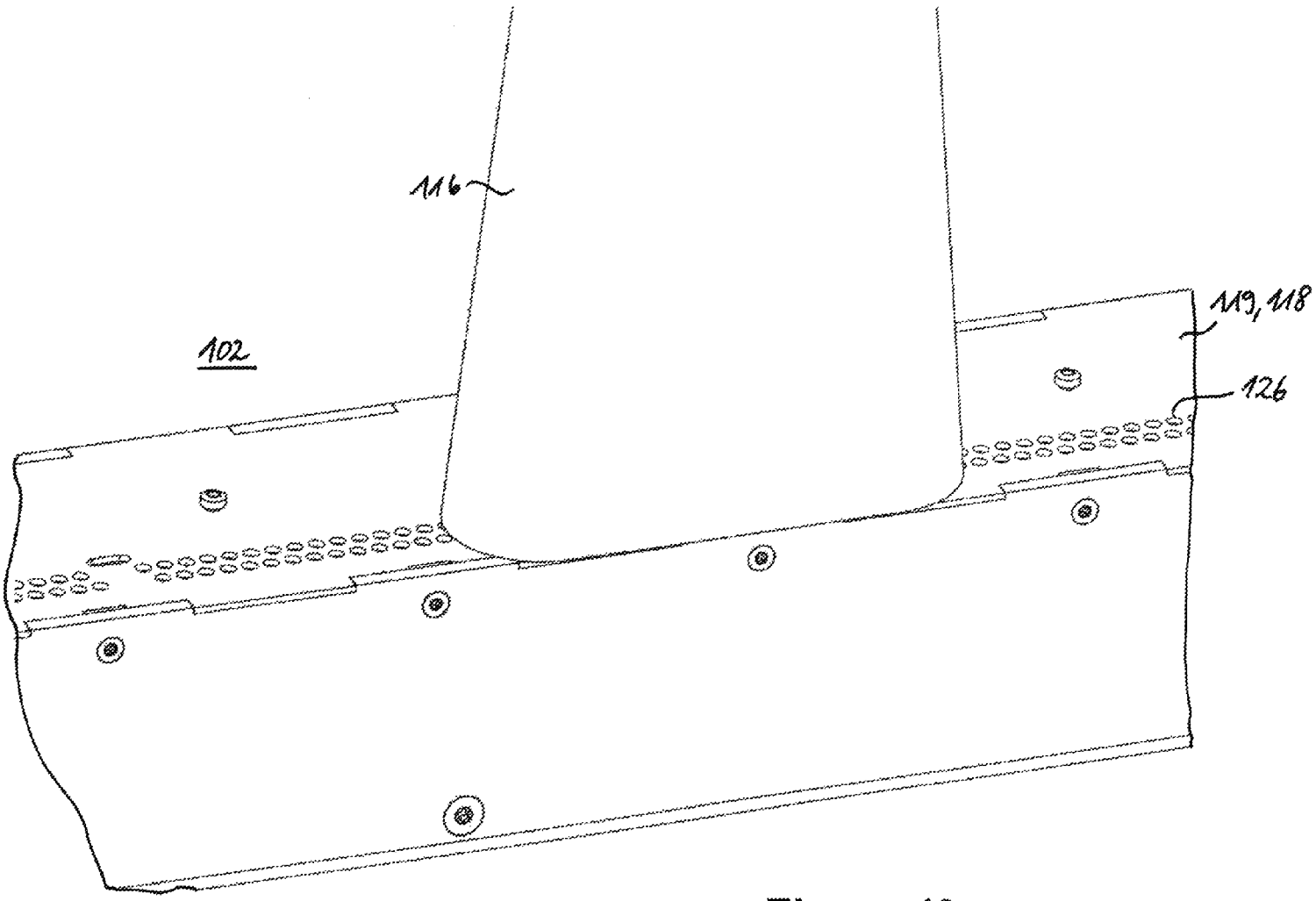
FIG. 19 a schematic display of the arriving light beam on the receiver side.

As shown in FIG. 19, a well-defined diverging radiation field 116 falls onto the respective opposite measuring rail, i.e. accordingly onto the respective different orifice rail 119 and/or 118.

Figure 20:
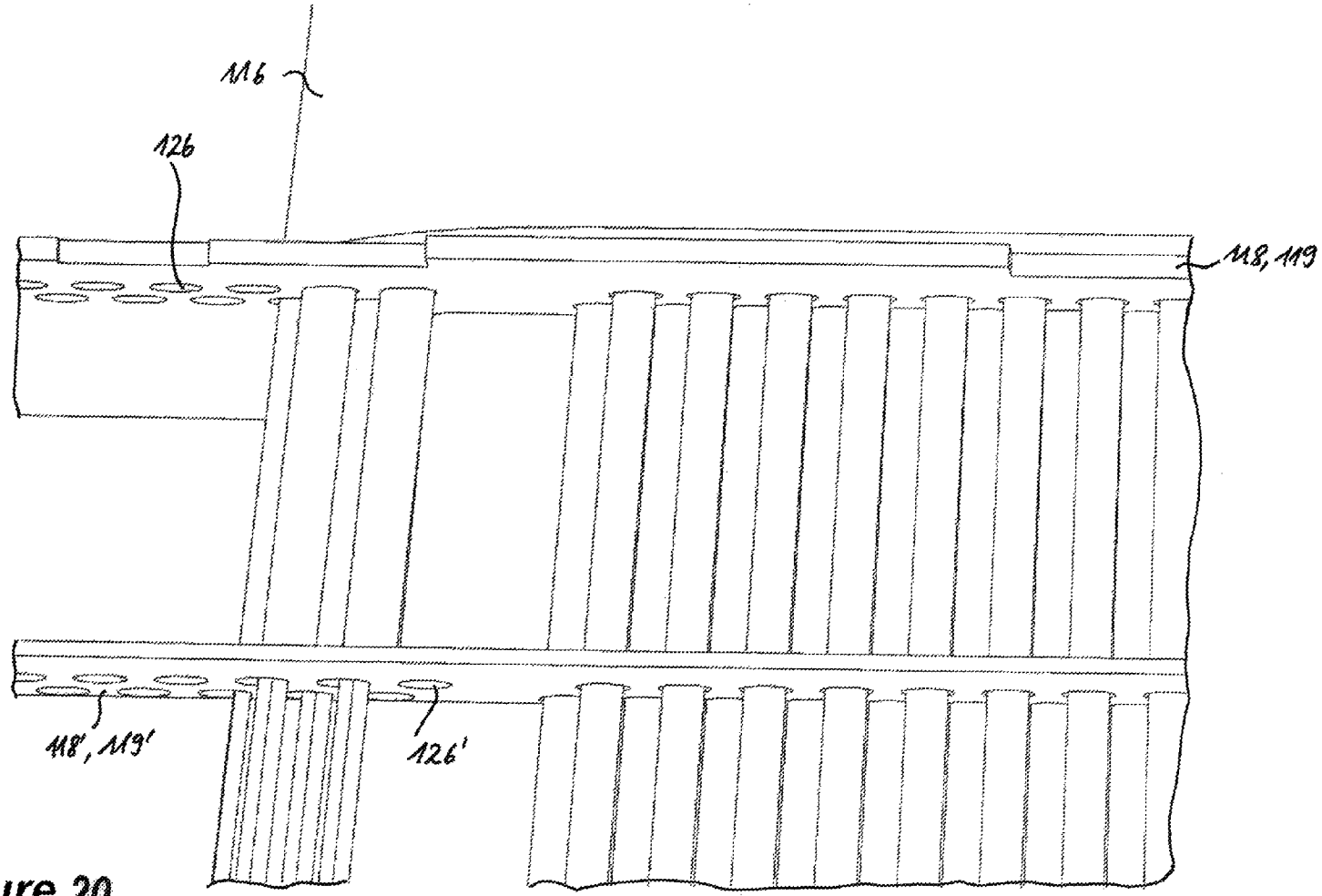
FIG. 20 a schematic display of the mode of action of the orifices on the receiver side.
Figure 21:
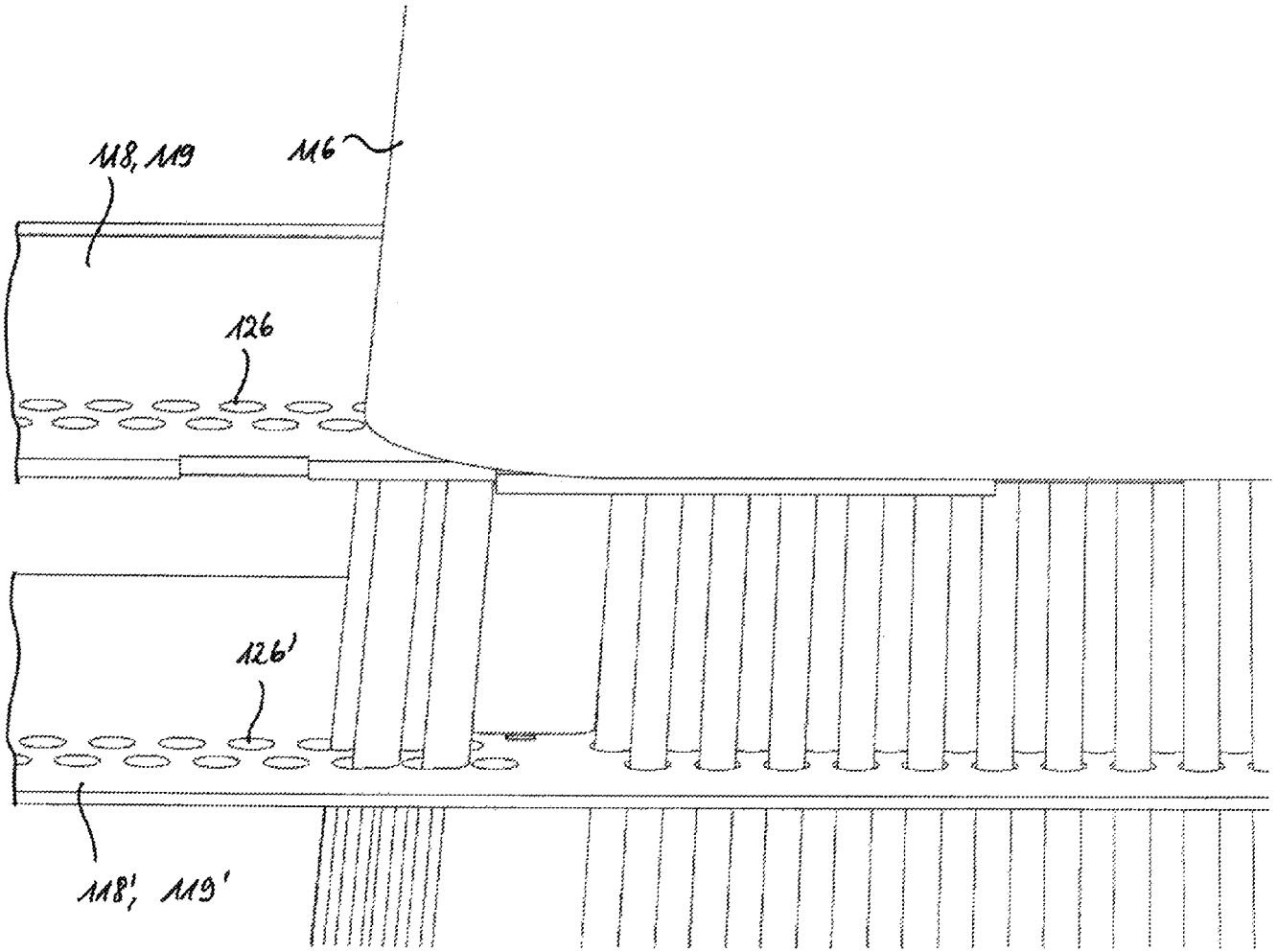
FIG. 21 a toppled display of the arrangement from FIG. 20.

As can be seen in the two detail views of FIGS. 20 and 21, the receiver pinhole apertures 126 and 126' cause a forming process of the radiation falling down to the receiver elements and in particular already a significant reduction of the radiation that falls onto the receiver elements that are not associated to the radiation source that is located directly opposite to them. This cutting process of the radiation by the pinhole apertures that are virtually not associated can be explained by the increased incidence angle under which the radiation comes in from a non-associated radiation source.

Figure 22:
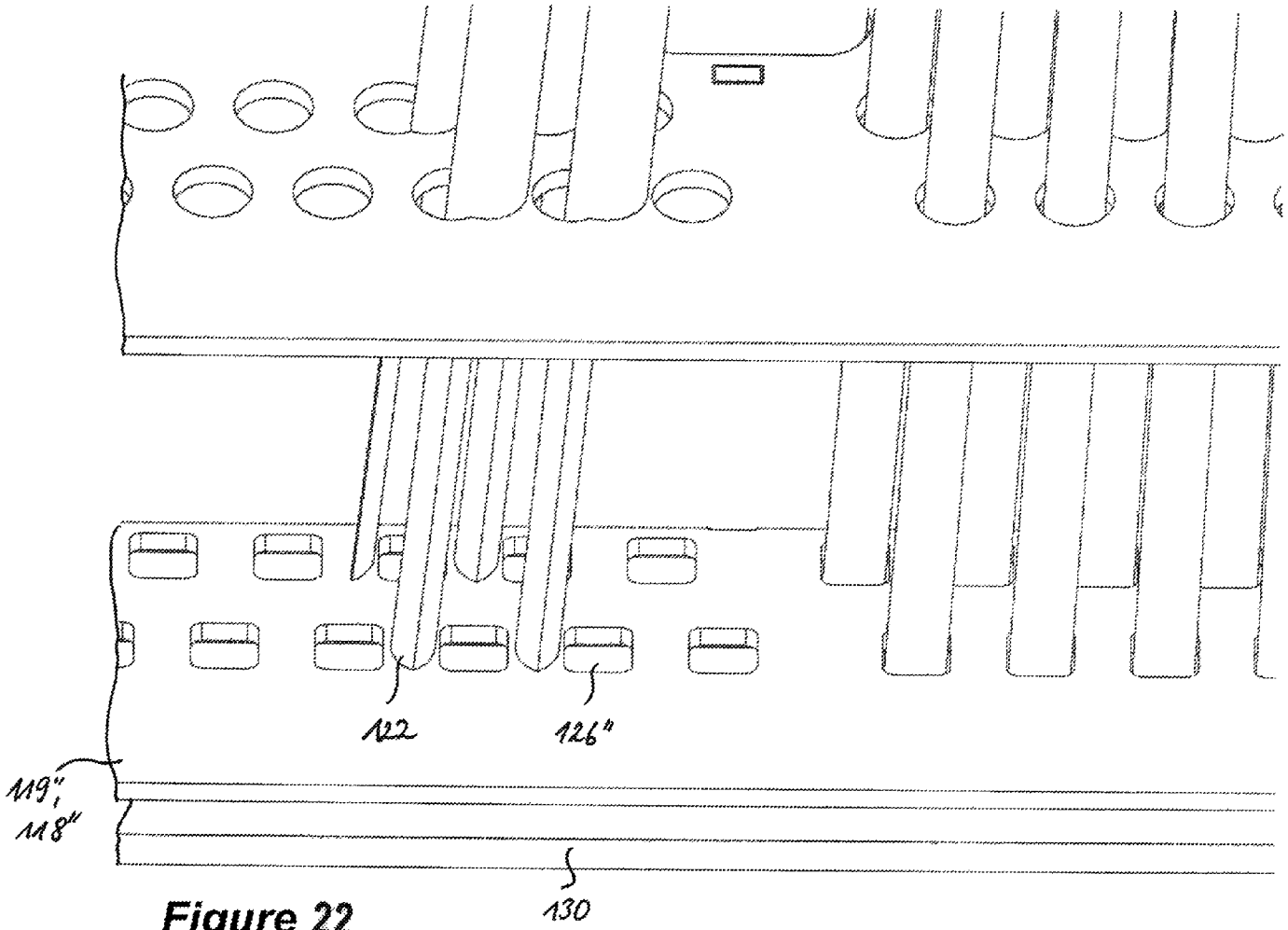
FIG. 22 a schematic display of the receiver systems and the orifice arrangement closest to them.
Figure 23:
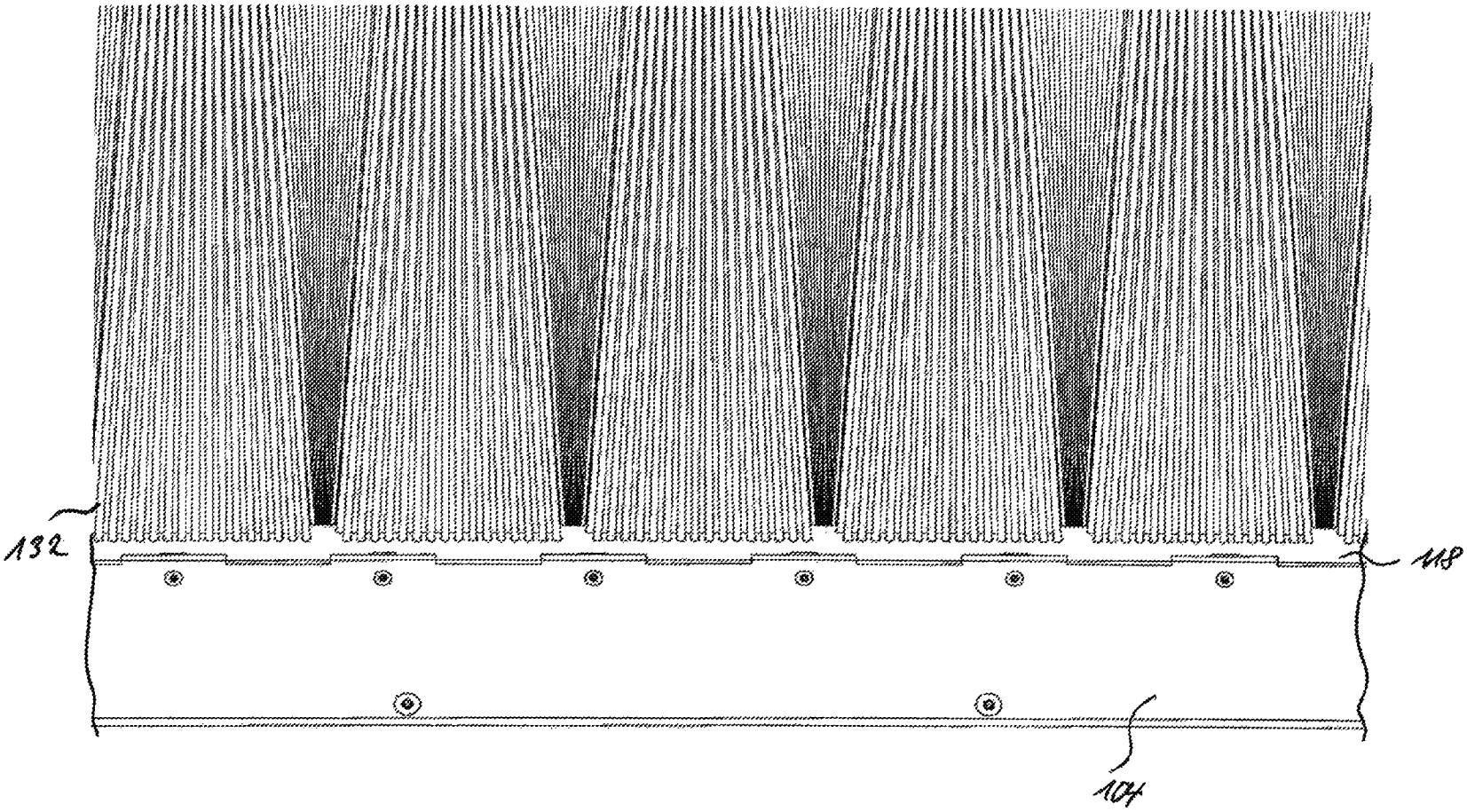
FIG. 23 a schematic display of the basis of calculation.
Figure 24:
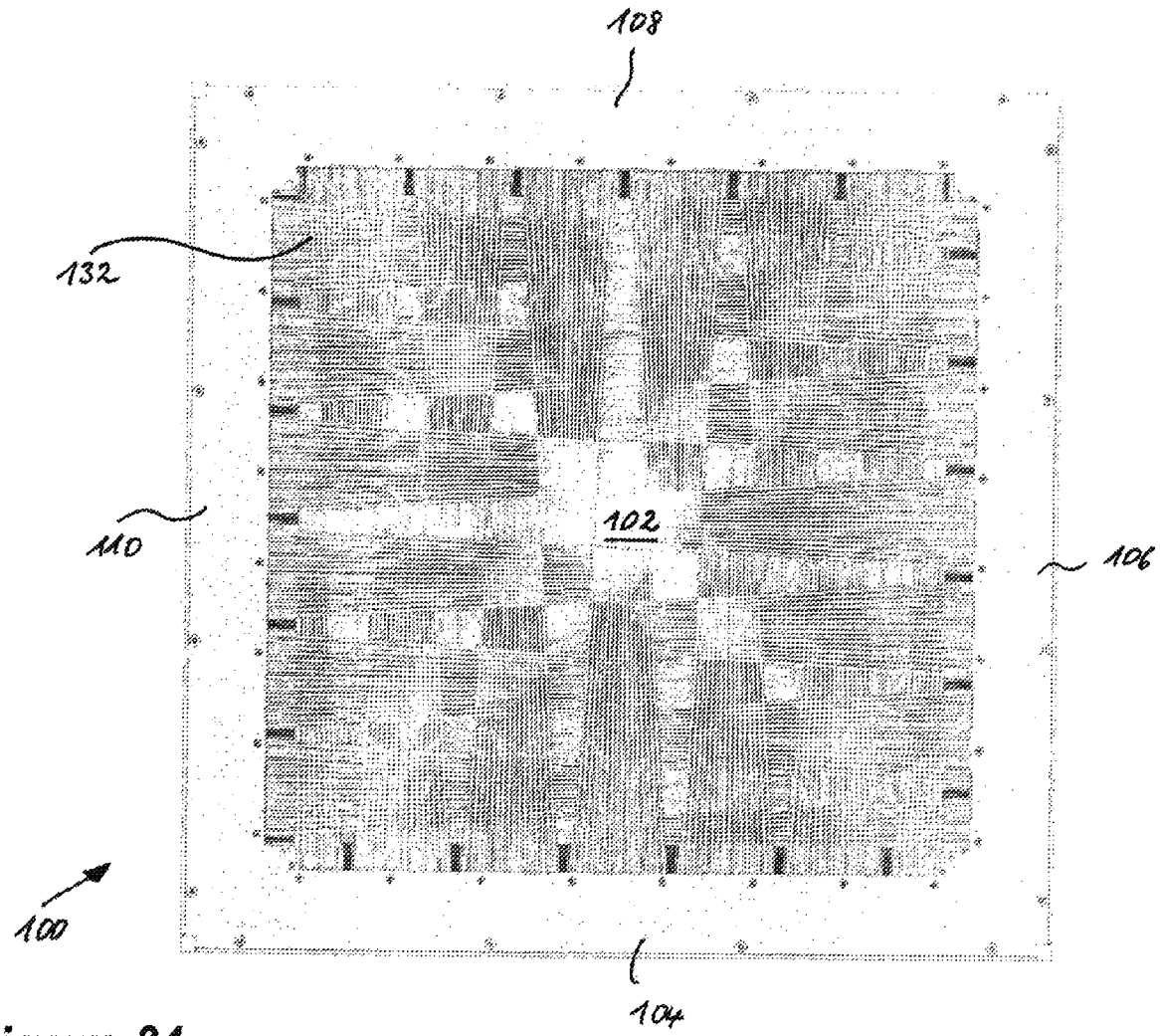
FIG. 24 a schematic display of the measuring field with fictitious light barriers that are used for calculation.

FIG. 22 subsequently shows the function of the innermost pinhole aperture 126". It can be seen that none of the scattered radiation 122 reaches the radiation carrier 130, on which the receiver elements are arranged, by passing through the rectangular pinhole apertures 126" anymore.

For the computational evaluation, the target plane 102 can therefore be imagined as permeated by individual virtual light barriers 132 as displayed in the following Figures to explain the computation principle. However, it shall be noted that the target plane 102 in purely physical terms is always penetrated by continuous radiation cones. Only the virtual light barriers 132 sketched in the following are used for the evaluation.

Figure 25:
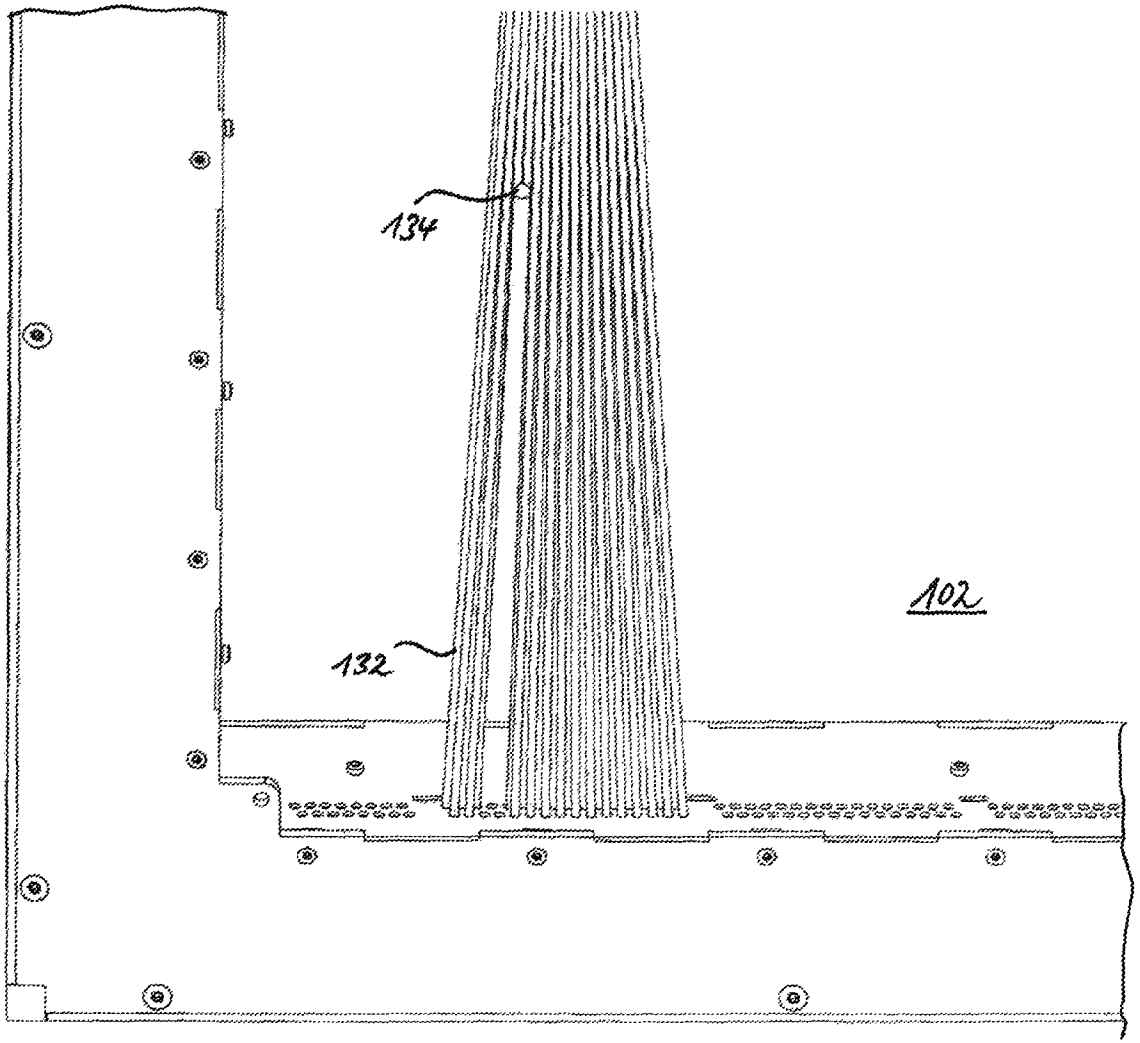
FIG. 25 a detail from FIG. 24 with the assumption that a bullet is flying through the target plane.

FIG. 25 shows the situation while a bullet 134 is flying through the target plane 102. In case of the caliber of the bullet 134, which is displayed in an exemplary way, three virtual light barriers 132 are interrupted. In other words, three receiver elements are not illuminated.

Figure 26:
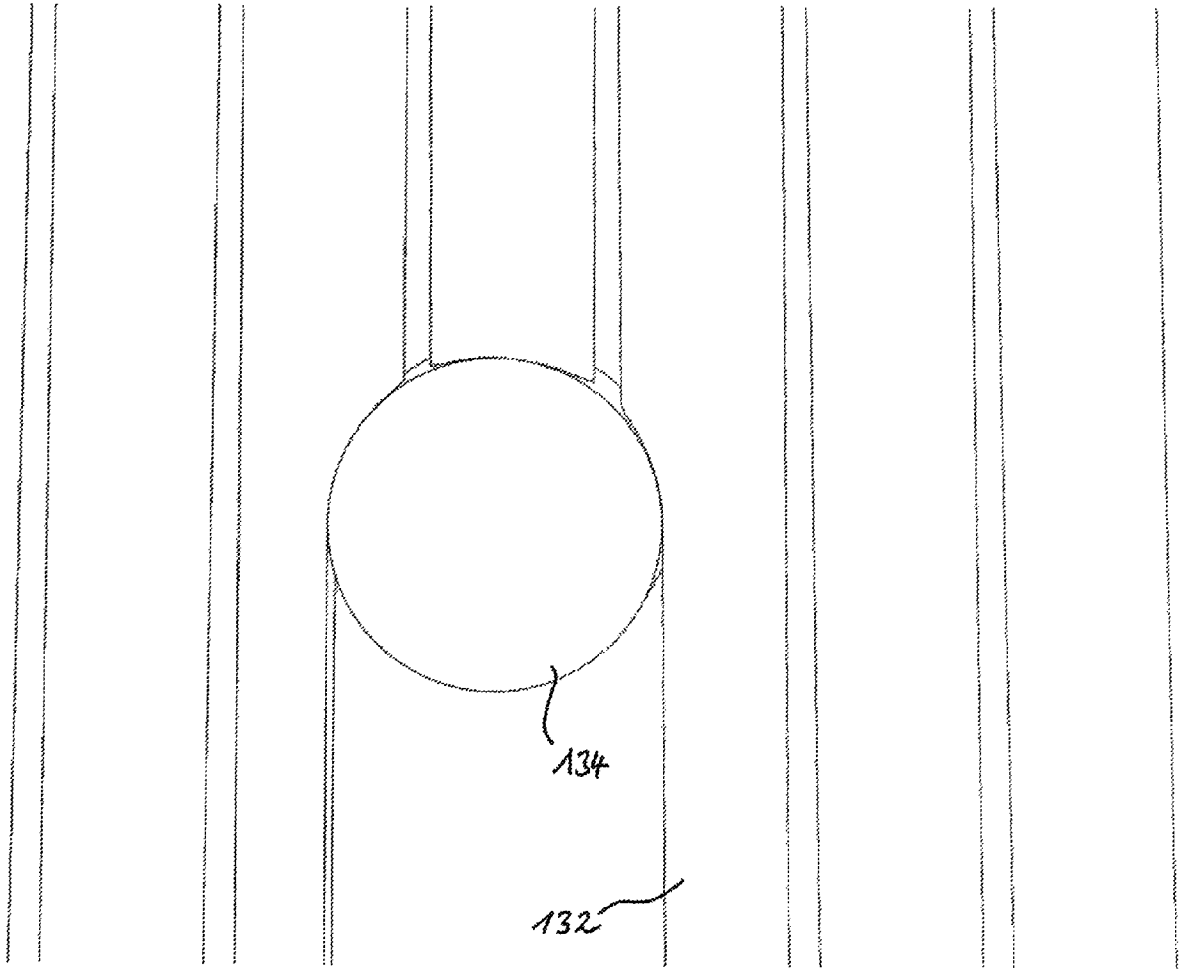
FIG. 26 a detail from FIG. 25.
Figure 27:
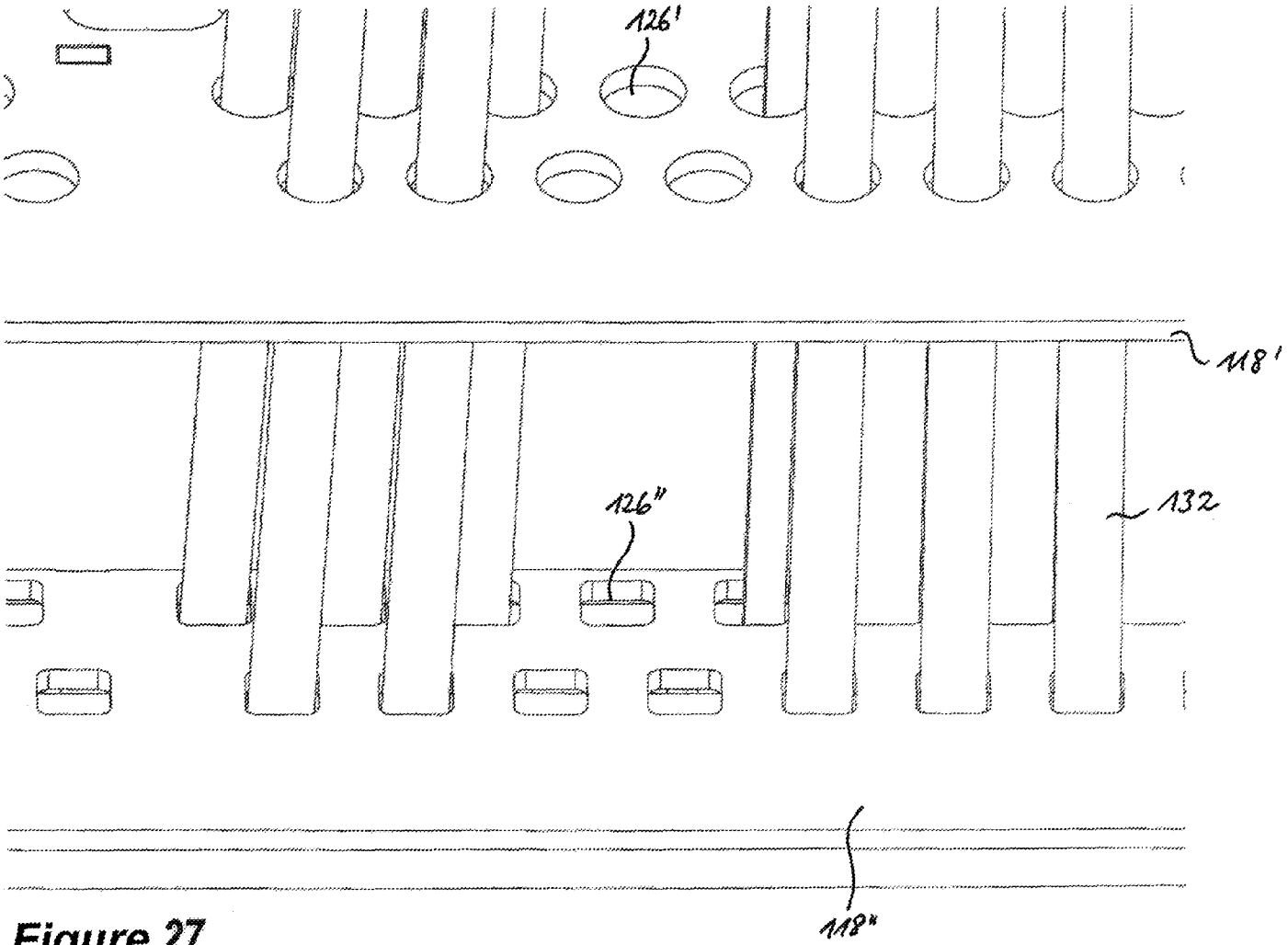
FIG. 27 a detail of the orifice arrangements close to the recipients during shading by a bullet.
Figure 28:
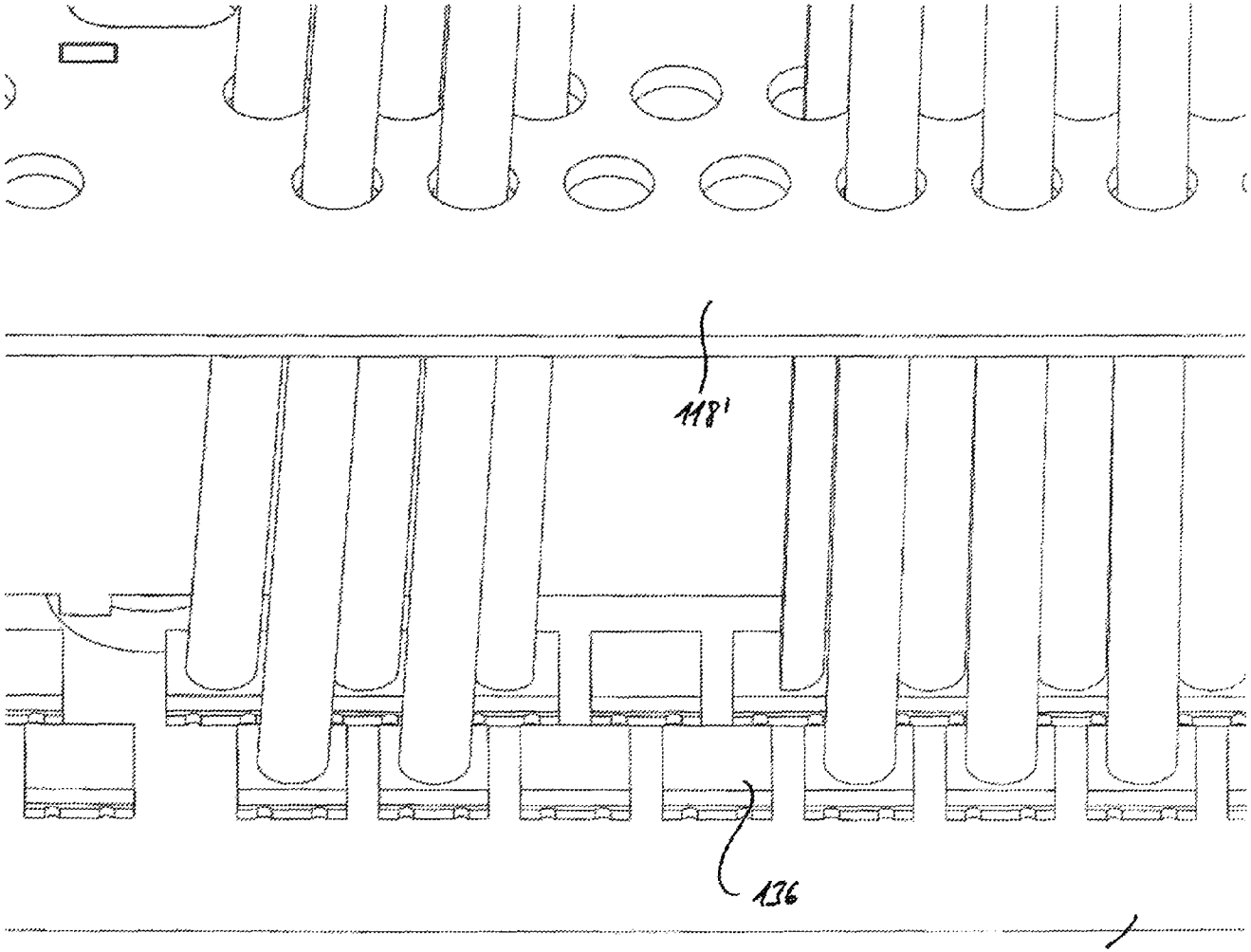

Depending on the gunshot position and the caliber of the bullet 134, light barriers can be interrupted entirely or only partially as sketched in FIG. 26. FIG. 27 shows a perspective display of the area of the rectangular receiver pinhole apertures 126" and it can be seen that in the situation shown in FIG. 25 exactly three receiver elements are not illuminated at all while a fourth receiver element receives only a part of a beam and therefore measures a reduced intensity. To explain the arrangement of the receiver elements 136, the orifice rail 119" of FIG. 28 is removed in the display of FIG. 28.

Figure 29:
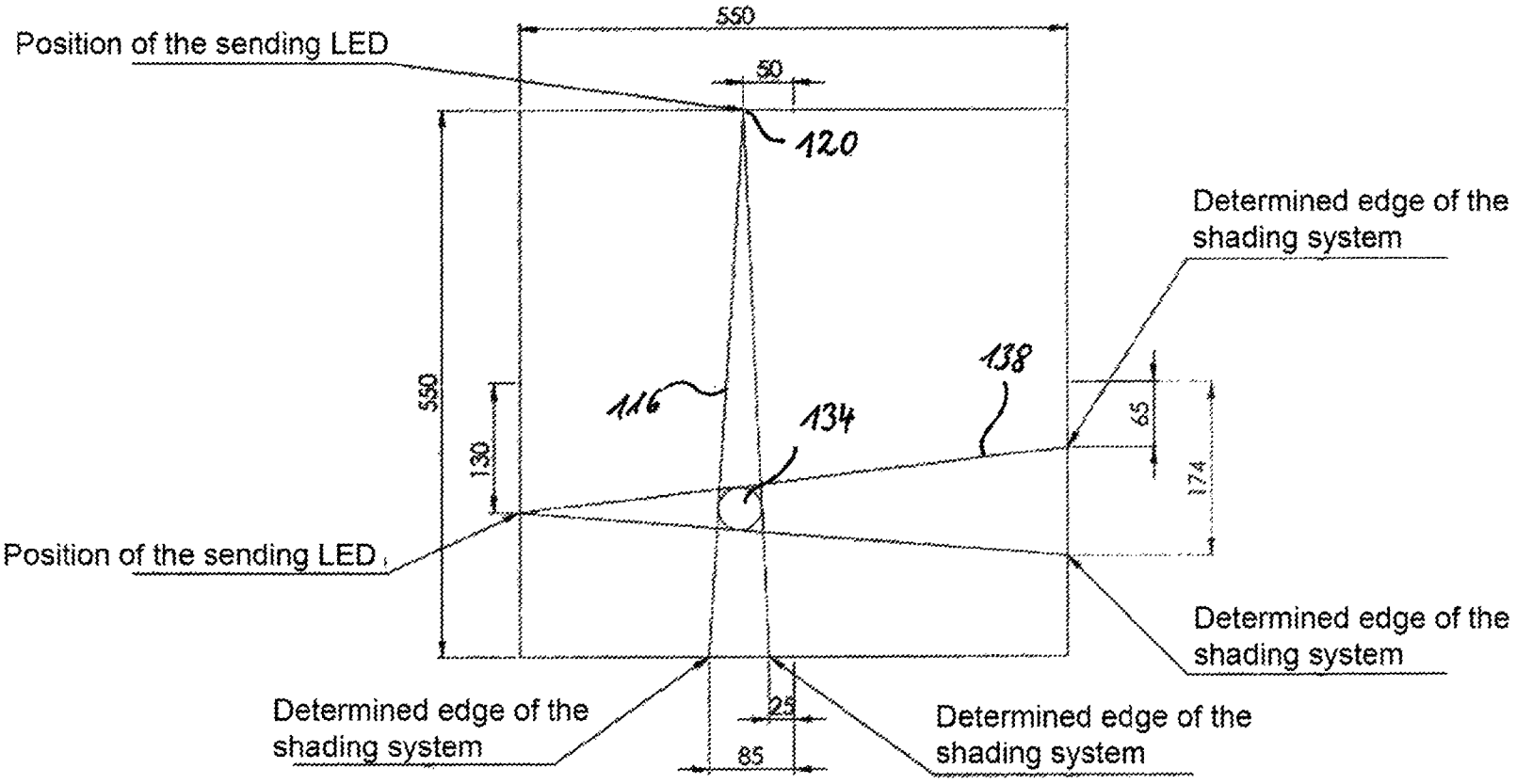
FIG. 29 an illustration of the basis of calculation to determine the tangents to a bullet.

With reference to all the Figures shown up to present and with the addition of FIG. 29, the evaluation according to the invention is explained in detail in the following:

As already mentioned, the measuring field consists of individual, essentially triangular light fields. An individual field has a light source 120 whose light radiates onto light-sensitive, array-shaped sensors. In order to be able to accurately measure the shadow of the bullet 134 in the radiation field 116, orifices are installed, as explained, ahead of the sensors and ahead of the radiation sources. These orifices ensure that the continuous radiation field 116 will be divided into a plurality of virtual light barriers. These are, for example 32 per receiver array in the present embodiment. The determined measurement value of each receiver element is divided, for instance, into a maximum of 220 levels. As already explained, the undesired impact of extraneous light, especially of radiation from adjacent radiation sources, on the measurement value is prevented by the intended orifices.

The measurement area that is equivalent to the target plane 102 is displayed in the evaluation model according to the present invention as the first quadrant of a Cartesian coordinate system. As shown in FIG. 29, the boundary points of the shadow are determined on a side that is opposite to respectively one radiation source. The coordinate of the respective pertaining radiation source 120 is mechanically predetermined and known, and therefore the boundaries of the shadow can be determined by means of two straight lines 138 that represent at the same time tangents to the bullet 134. As the measurement occurs by means of two intersecting radiation fields 116 from two different radiation sources 120, there will be a total of four tangents 138 between which the bullet 134 has to be located. The intersection points of the four straight lines 138 form the corner points of a tangent quadrilateral.

In addition, the intersection point of the angle bisectors of the respective pair of straight lines is the center of the bullet to be measured and hence the gunshot position to be determined. Further, the diameter of the bullet, the caliber, can be derived on the basis of the tangents by means of simple trigonometric calculation.

As a circle is unambiguously described by the contact points of three tangents adjacent to it, the calculation method according to the invention can be used for a plausibility check as the measured fourth tangent provides a redundant piece of information.

To obtain optimal measurement values, one of the radiation sources can be switched off for a short time, for example for approx. 200 μs. This leads to a radiation change that is equivalent to a hundred percent shading of the receiver elements on the opposite. The values determined by means of this calibration step can be used to calibrate the measuring frame. For example, recalibration is possible by means of the calibration values after each measurement.

In addition, radiation intensity changes that arise, for example, due to contamination can also be checked during the operation. In particular, the quality of the measuring field can be monitored, for example, through sequential switch-off of the radiation sources directly after each measurement process. New calibration values are generated and can be used, together with the original calibration values, to calculate calibration factors by dividing the new value by the original calibration value. These calibration factors can, on one hand, be used to determine the position of the bullet 134 as accurately as possible. On the other hand, a change of the radiation intensity can also be determined based on these factors and used to inform a user at the earliest possible time about a deteriorated condition of the measuring frame. For example, threshold values can be compared to determine the still permissible decrease of the light intensity.

Gunshot indication systems that are reliable, cost-efficient and that determine and indicate gunshot positions extremely accurately can be developed with the evaluation according to the invention and the described measuring frame. Furthermore, the dimensions of a measuring frame according to the invention can be kept as low as to maintain the maximum dimensions between the center of a target towards the center of the adjacent target which are required for all competitive approval processes. For example, the maximum permissible center-center distance of 750 mm between two targets for a target diameter of 500 mm (distance 25 m) can be maintained. These maximum dimensions are required for the ISSF (International Shooting Sport Federation) approval for the measurement in the Olympic discipline "Rapid Fire".

The invention claimed is:

1. A measuring frame for contactless optical determination of a gunshot position of a bullet through a target area, whereby the measuring frame comprises:

at least a first radiation source to send out a first diverging radiation field;

at least a second radiation source to send out a second diverging radiation field, whereby the first and the second radiation field intersect in a plane, which is transversal to a gunshot direction, under an angle;

at least a first and at least a second optical receiver unit that are associated respectively to the at least first and a second radiation source;

whereby each of the optical receiver systems has an array of optical receiver elements that can be evaluated in a way that a spatially extended shading position is determined as a consequence of the bullet to be detected;

further comprising at least one receiver orifice to fade out undesired radiation, wherein the receiver orifice has successive pinhole apertures in the beam direction with different aperture shapes.

2. The measuring frame according to claim 1, whereby the optical receiver elements are arranged in at least two rows and the receiver elements of one row are arranged in a shifted way in relation to the receiver elements of an adjacent row.

3. The measuring frame according to claim 1, whereby each of the receiver elements comprises a photodiode.

4. The measuring frame according to claim 1, whereby the radiation source, a light-emitting diode (LED), emits the infrared radiation or has a laser diode.

5. The measuring frame according to claim 1, further comprising at least one sender orifice to shape the radiation field emitted by the radiation source.

6. The measuring frame according to claim 5, whereby the sender orifice has successive pinhole apertures with an increasing aperture diameter in the beam direction.

7. The measuring frame according to claim 1, whereby the receiver orifice has an array of pinhole apertures of which each is associated with an optical receiver element.

8. The measuring frame according to claim 1, whereby the first and second radiation source and the first and second receiver unit are respectively arranged in a way that the central axes of the emitted radiation fields essentially intersect in a right-angled way.

9. The measuring frame according to claim 1, whereby the measuring frame delimits the target area in an essentially rectangular way and is equipped with four substantially identical measuring rails that are arranged along the edges of the rectangular delimitation.

10. The measuring frame according to claim 9, whereby each of the measuring rails comprises at least one radiation source and at least one receiver unit.

11. A process for contactless optical determination of a gunshot position of a bullet through a target area using a measuring frame according to claim 1, whereby the process comprises the following steps:

emission of at least a first and at least a second diverging radiation field starting from a first and a second radiation source, whereby the first and second radiation field intersect in a plane that is transversal to a gunshot position at an angle;

determination of a shading system on at least a first and on at least a second receiver system, which are respectively associated to the at least one first and a second radiation source;

calculation of at least three tangents using the delimitations of the determined shading systems and the position of the associated radiation source;

calculation and indication of the gunshot position and/or the caliber on the basis of the calculated tangents.

12. The process according to claim 11, whereby four tangents are calculated and a plausibility check of the measured values is performed by means of the redundant information.

13. The process according to claim 11, further comprising a calibration step in which the at least single radiation source is switched off for a short time and a difference value of the radiation intensity between the illuminated and the non-illuminated state of the associated receiver unit is used to determine a calibration factor.

14. The process according to claim 13 whereby the difference value is compared to a threshold value in order to create a warning message when the threshold value is undercut.

15. A display system to display a gunshot position of a bullet through a target with at least one measuring frame according to claim 1, at least one evaluation system and at least one display unit.

* * * * *